United States Patent [19]

Korsunsky et al.

[11] Patent Number: 4,995,825

[45] Date of Patent: Feb. 26, 1991

[54] ELECTRONIC MODULE SOCKET WITH RESILIENT LATCH

[75] Inventors: Iosif Korsunsky, Harrisburg; Richard C. Schroepfer, Thompsontown; James A. Leidy, Hummelstown, all of Pa.

[73] Assignee: AMP Incorporated, Harrisburg, Pa.

[21] Appl. No.: 495,886

[22] Filed: Mar. 19, 1990

[51] Int. Cl.[5] ..... H01R 13/62

[52] U.S. Cl. ..... 439/328; 439/326; 439/62

[58] Field of Search ..... 439/325, 326, 327, 372, 439/629, 630, 64, 297, 350, 352, 357, 358, 328, 62

[56] References Cited

U.S. PATENT DOCUMENTS

| | | | |
|---|---|---|---|
| 3,711,816 | 1/1973 | Schumacher | 439/353 X |
| 4,693,533 | 9/1987 | Szczesny et al. | 439/350 |
| 4,726,783 | 2/1988 | Nakazawa et al. | 439/350 |
| 4,850,891 | 7/1989 | Walkup et al. | 439/64 X |
| 4,850,892 | 7/1989 | Clayton et al. | 439/326 |
| 4,898,540 | 2/1990 | Saito | 439/326 X |

OTHER PUBLICATIONS

Meyer, "Spring Retainer for Retention of Cable Connector", IBM TDB, vol. 20, No. 5, 10-77.

*Primary Examiner*—David L. Pirlot
*Assistant Examiner*—Julie R. Daulton
*Attorney, Agent, or Firm*—Robert W. Pitts; Allan B. Osborne

[57] ABSTRACT

A socket for interconnecting an electronic module to a circuit board includes an insulative housing having a plurality of terminals applying a moment to the module. A U-shaped latch is positioned within a pocket at each end of the insulative housing. The U-shaped latch is of metal and has two legs joined by a bight, the two legs being flexible as the module is rotated into a slot in the insulative housing. The U-shaped latch includes a tab extending around an upwardly extending projection on the backwall of the housing to provide additional support to the latch. The latch thus provides means for holding the module securely within the housing after rotation to an upright position.

20 Claims, 9 Drawing Sheets

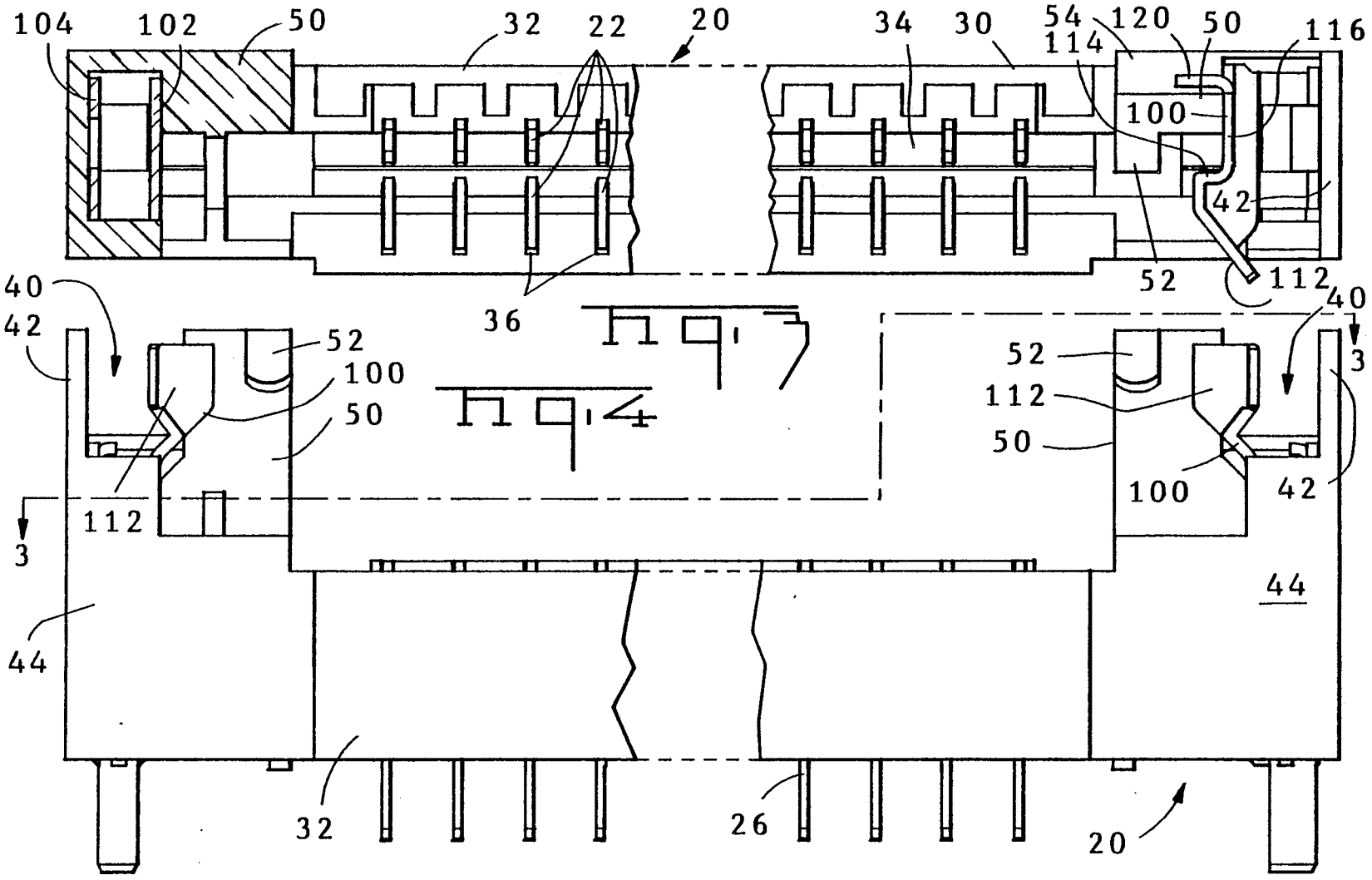
116
50
120
54
114
30
34
20
22
32
50
102
104
100
42
112
40
3
52
100
50
112
44
20
26
36
52
100
50
112
40
42
3
44
32

116
114
120
112
110
108
104
100
106
102

118
122
116
112
114
120

120
122
110
118
104
108

110
122
102
118
104
108
106

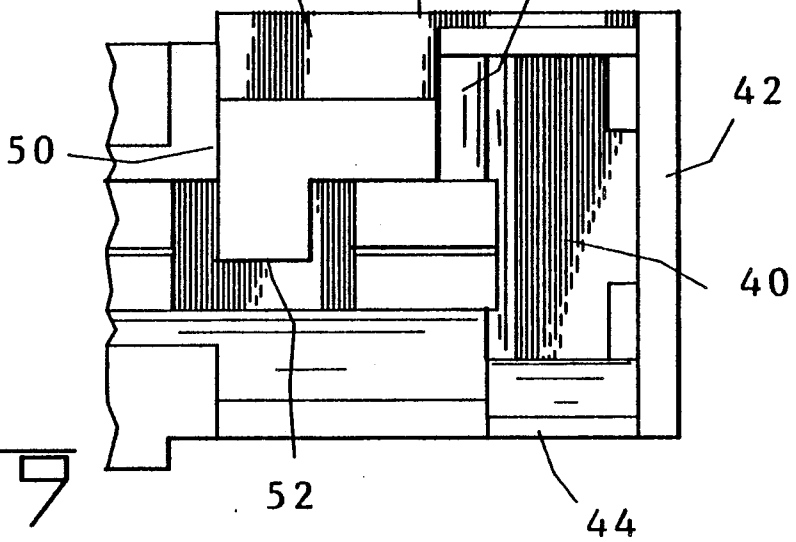
FIG. 9
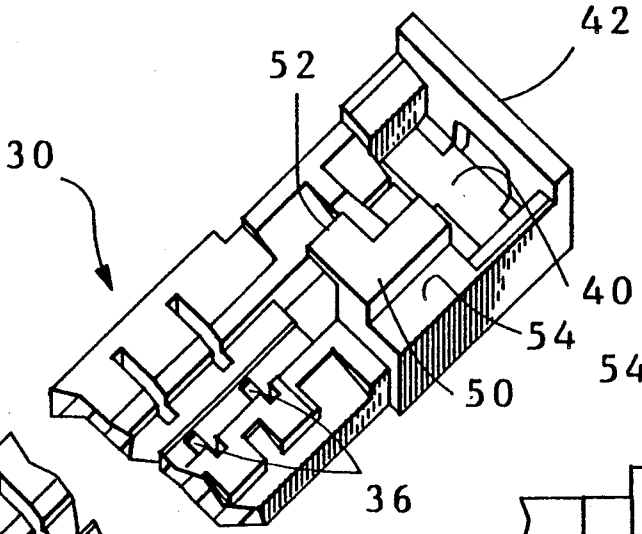
FIG. 10
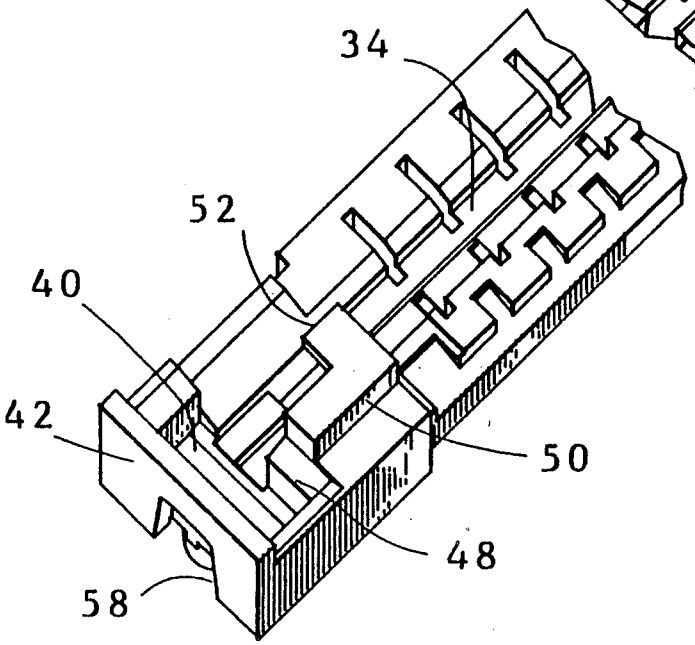

ELECTRONIC MODULE SOCKET WITH RESILIENT LATCH

BACKGROUND OF THE INVENTION

1. Field of the Invention

This application relates to an electrical connector or socket for establishing an interconnection with an electronic module and more specifically relates to a zero insertion or low insertion force socket having a resilient latch for securing an electronic module, such as a single in-line memory module, in position within the socket housing.

2. Description of the Prior Art

Single in-line memory modules (SIMM) represent a high density, low profile single in-line package for electronic components such as dynamic random access memory integrated circuit components. A plurality of these components can be mounted in line on a circuit panel whose height is little more than the length of the components themselves. The circuit panels can in turn be mounted on a printed circuit board daughtercard which can then be mounted on a printed circuit board mothercard. The spacing between adjacent daughtercards would then need to be only slightly greater than the height of the individual circuit panels or single in-line memory modules.

One approach for mounting single in-line memory modules on a daughterboard would be to employ plug in leads adjacent to one edge of the circuit panel. These plug in leads can then be connected to conventional printed circuit board contacts such as miniature spring contacts.

Sockets or connectors containing a plurality of contacts can also be used to interconnect single in-line memory modules on a printed circuit board. For example, U.S. Pat. No. 4,737,120 discloses an electrical connector of the type suitable for use with a single in-line memory module in which a zero or low insertion force interconnection is established between the terminals and the pads on the circuit panel. The circuit panel is inserted at a angle and then cammed into position. The insulative housing on the connector provides a stop to hold the circuit panel in position. Other low insertion force connectors are disclosed in U.S. Pat. No. 4,136,917; U.S. Pat. No. 4,575,172; U.S. Pat. No. 4,826,446 and in U.S. Pat. No. 4,832,617. Another socket of this type is shown in U.S. Pat. No. Application Ser. No. 07/398,795 filed Aug. 24, 1989. The contact terminals in each of these patents is edge stamped. Sockets using terminals of this type are suitable for use on center line spacings on the order of 0.050 inches.

For conventional zero or low insertion force single in-line memory module sockets, integrally molded plastic latches are normally used to hold the modules in position. The configuration of the latch members provides the latch members with the resilient characteristics required in order to allow the latch members to cooperate with the daughter board to maintain the daughter board in electrical engagement with the terminals of the connector.

However, several problems are associated with the configuration of the latch member described above. The most common failure mode for plastic latches is caused by the lack of wear resistance on the camming surfaces of the plastic latch hooks. These hooks can also be sheared, partially or completely, if the edges of the module P.C. board are sharp. Shearing would also occur if the module P.C. board is excessively long and drives the latch against the latch stop. This latch stop on conventional plastic housings is to prevent the latch from being overstressed, however, if deflection is retarded at a certain point and the hook is placed in shear.

The plastic latches can also be broken if the outward load is excessive, such as impact against the module, or if the operator pulls outward before deflecting the latches enough to disengage the hook from the edges of the modules. Since these connectors are designed for approximately twenty-five insertions and withdrawals, the likelihood of excessive loads being placed on the plastic latches is significant.

Stress relaxation is also more of a problem with plastics, suitable for use with single in line modules, than for more resilient materials, Slight permanent set also occurs during the first cycle to full deflection of the plastic latch. Slight set during the additional (24) cycles can also occur. Consequently, as the memory module circuit panels can vary in size, and still fall within the tolerance limits for the connector, it is possible that a relatively large board will be inserted into the slots, and then be followed by a relatively small board. The insertion of the large board into the slot can cause the plastic latch to take a permanent set, so that as the small board is inserted, the latch will not be effective in maintaining the board in the slot, resulting in an ineffective connector.

Another problem with insulative housings having integrally molded latch members is that not all insulative materials, otherwise suitable for socket housings, can be used to mold housings having deflectable latch arms. Typically, the plastics suitable for use in a connector housing with deflectable integrally molded latch arms, are more expensive than other materials. Plastics that would provide molded latches that would exhibit toughness and resiliency, and little permanent set at room temperatures can lose those performance requirements when subjected to elevated temperatures. It is essential the connector body of the single in line memory module connectors or sockets remain stable, without distorting under load. There are liquid crystal polymers which do meet the performance criterion for single in line memory module connector housings. Quite often, additional care must be taken in molding such materials, resulting in additional expense as part of the mold tooling or the cycle of the molding operation. For example, U.S. Patent Application Ser. No. 07/234,362, filed Aug. 18, 1988, discloses steps necessary to mold integral members extending at right angles to the direction of flow of a liquid crystal polymer used in a single in-line memory module socket of this type. Elimination of these orthogonally projecting members, such as integrally molded plastic latches, would simplify the molding of the insulative housings and might even result in the use of less expensive plastics which do not exhibit the resilience otherwise required.

One option which avoids the need to use integrally molded plastic latches, is the use of separate metal latch formed of the spring material. A greater deflection is obtained with less set with a metal latch. A metal latch is less likely to shear and wear will be minimal. U.S. Patent Application Ser. No. 07/313,261 filed Feb. 21, 1989. The compliance of that latch is, however, restricted by the fact that is is partially anchored at its base. Another problem is that the forces placed upon a metal latch of this type during insertion of the single in-line memory module into the socket and as a result of the movement placed upon the electronic module by the terminal spring contacts, must be transmitted to a relatively fragile housing. The fragility of the housing is in part due to the dimensional constraints placed upon the socket, which results in the necessity to use relatively thin sections in the insulative housing.

A metal latch member, having sufficient compliance for use in a single in-line memory module and permitting simplification of the configuration of the molded insulative housing is therefore quite desirable. The instant invention provides just such a resilient metal latch for use in a single in-line memory module socket.

SUMMARY OF THE INVENTION

A socket suitable for use in interconnecting an electronic module to a circuit board comprises an insulative housing containing a plurality of terminals and resilient means for holding the module in a first position within the housing and resisting the moment applied to the module by the terminals. A resilient latch suitable for use in such an application comprises a U-shaped latch positioned within a pocket on one end of the insulative housing. The U-shaped latch has inner and outer legs joined by a bight at the bottom of the U-shaped latch. A wedge shaped projection is provided at the upper end of the inner legs and when the wedge shaped projection engages an edge of an electronic module circuit panel during rotation of the electronic module into the housing, the inner and outer legs are both stressed and the inner leg is deflected toward the outer leg. The stresses are transmitted through the U-shaped latch so that a more compliant spring is provided.

In order to support the stresses placed upon the resilient latch, a tab is provided which wraps at least partially around a relatively sturdier backwall of the insulative housing. In this manner, damage to the insulative housing can be avoided.

BRIEF DESCRIPTION OF THE DRAWINGS

FIG. 3 is a top view, partially in sections, of the single in-line memory module of FIG. 1.

FIG. 4 is a front view of the single in-line memory module socket in FIG. 1.

FIG. 9 is an exploded top view of one end of the insulative housing showing the details of the pocket in which the resilient metal latch is positioned.

FIG. 10 is a perspective view showing the top of the ends of the insulative housing, also showing further details of the pocket in which the resilient latch is positioned.

DETAILED DESCRIPTION OF THE PREFERRED EMBODIMENT

Figure 1:
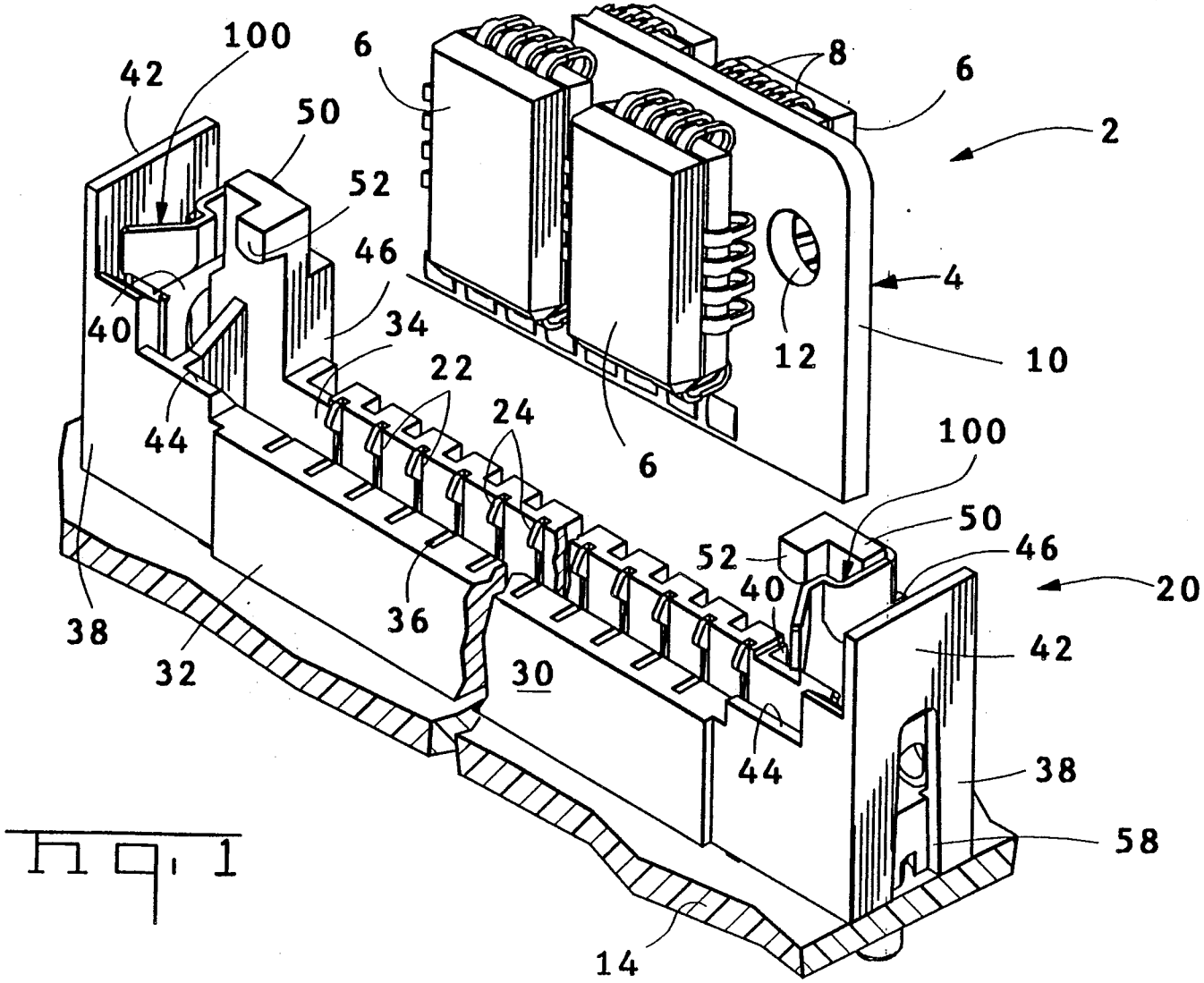
FIG. 1 is a perspective view of one embodiment of a single in-line memory module socket having integral latches at each end.
Figure 2:
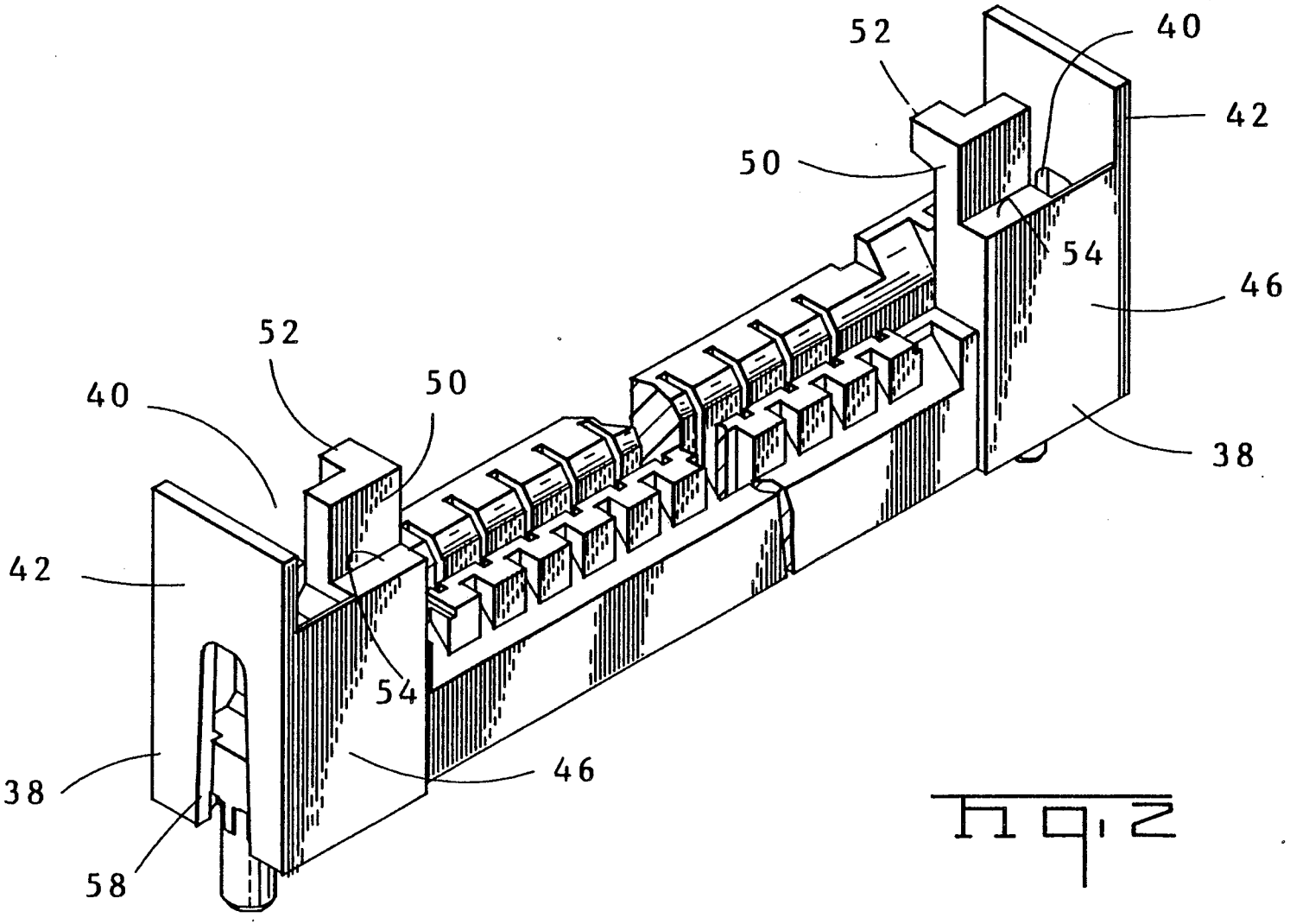
FIG. 2 is a perspective view showing the rear of the insulative housing of the socket shown in FIG. 1.
Figures 5, 6, 7, 8:
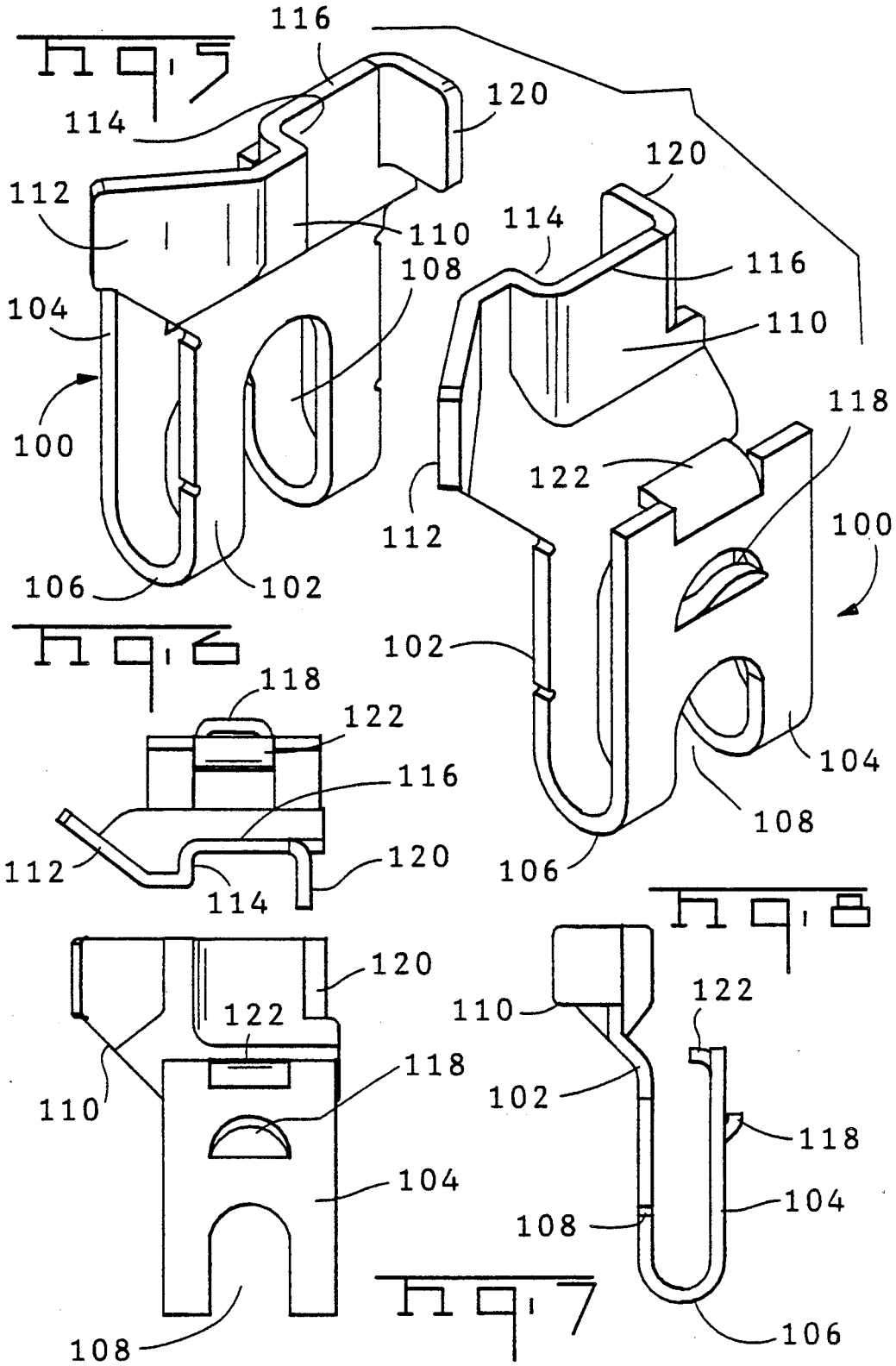
FIG. 5 shows left and right opposed resilient metal latches of the type which would be positioned on opposite ends of one single in-line memory module socket.
FIG. 6 is a top view of the resilient metal latch.
FIG. 7 is a front view of the metal latch.
FIG. 8 is an end view of the metal latch.
Figure 11:
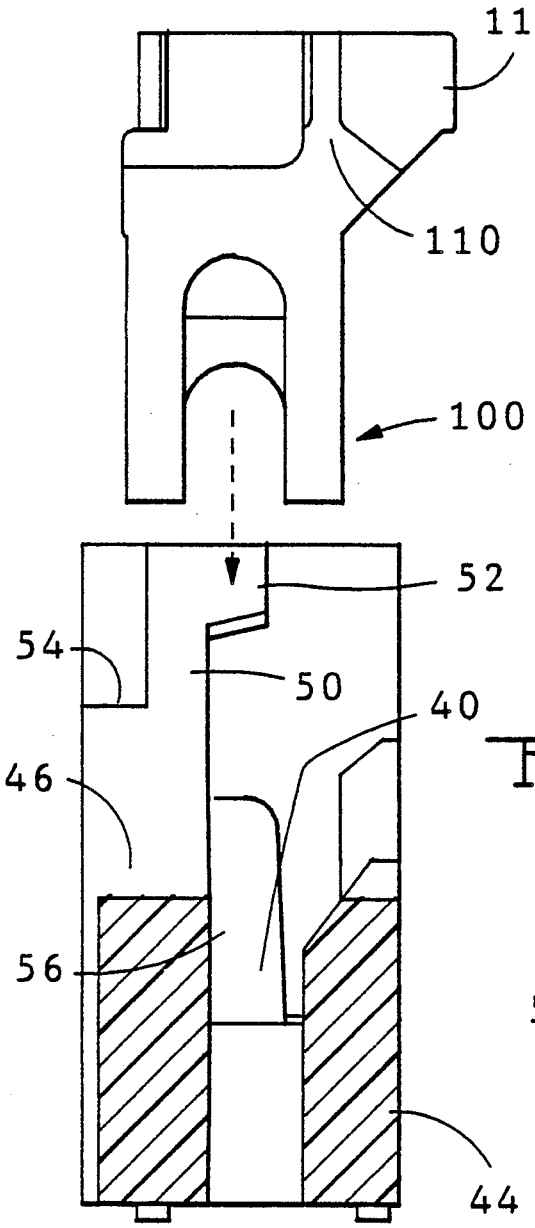
FIG. 11 is an exploded sectional view illustrating the manner in which the resilient terminal is inserted into the pocket from the top of the housing.
Figure 13:
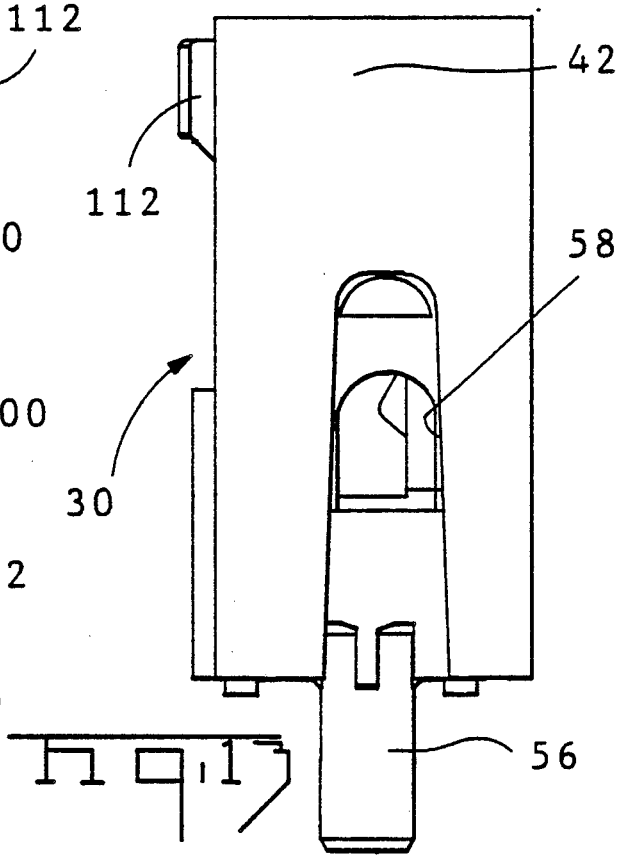
FIG. 13 is a end view of the single in-line memory module socket.
Figure 12:
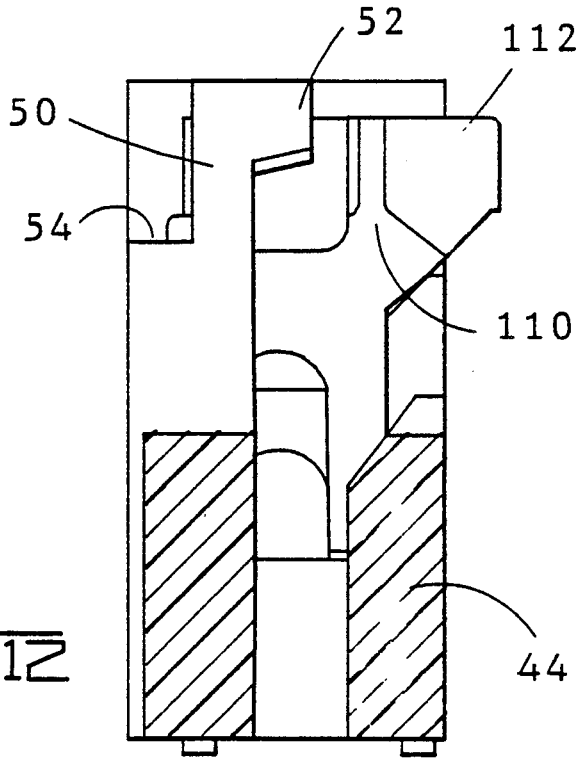
FIG. 12 is a sectional view showing the latch positioned within the pocket.

An electronic module, such as a single in-line memory module is shown in FIG. 1. Electronic module 2 comprises a circuit panel 4 having a plurality of integrated circuit components 6 secured to one or both sides of the circuit panel 4 by leads 8. Integrated circuit components 6 can comprise random access memory packages such as J-leaded packages. Each circuit panel 4 has a hole 12 located along each edge 10. These circuit panels 4 are normally manufactured in accordance with JEDEC standards. Although JEDEC standards are applicable to single in-line memory modules, it should be understood that many modules of this type may be manufactured in such a way that they are not in strict compliance with applicable standards. For example, the thickness or length of the individual circuit panels 4 may not be in compliance with JEDEC standards. This non-uniformity does cause some problems in assuring that a single socket can handle the entire range of modules with which it might be used.

Socket 20 comprising the preferred embodiment of this invention is used to interconnect an electronic module 2 to a printed circuit board 14. Each socket 20 comprises an insulative housing 30 having a plurality of terminals 22 positioned therein. Each terminal 22 includes contact section 24 facing upwardly and terminal leads 26 extending from the lower surface of the insulative housing 30. Terminals 22 establish electrical contact circuit panel 4 with connecting pads 21 on the circuit panel 4. The details of the particular contact terminals 22 are not part of the inventive subject matter of this socket. These contacts can be of the type shown in U.S. Pat. No. 4,737,120, incorporated herein by reference. These terminals can also be of the type shown in U.S. Patent Application Ser. No. 07/398,795 filed Aug. 24, 1989, also incorporated herein by reference.

Insulative housing 30 comprises a one piece molded member formed of a suitable insulative material. A liquid crystal polymer can be used to mold the insulative housing 30. Other materials such as polyphenylene sulfide, also known as Ryton, a trademark of Phillips Petroleum Company, Ryton might also be used to fabricate this insulative housing 30. Housing 30 has a central body 32 extending between right and left support members 38. The central body 32 has a plurality of terminal cavities 36 which intersect a central slot 34. The electronic module 2 is received within the slot 34. In order to position the electronic module 2 in the slot 34, the circuit panel 4 of the module 2 is inserted into the slot 34 and the module is rotated to an upright position. Again the configuration of the slot 34 and the intersecting terminal cavities 36 does not in and of itself comprise the subject matter of this invention. The configuration of the terminal cavities 36 and the slot 34 can be chosen to correspond with the specific terminal 22 employed therein.

Each of the support members 38, which comprise an integral part of the insulative housing 30, contains a pocket extending inwardly from the upper surface of the insulative housing 30 toward the lower surface, as best seen in FIG. 9 and 10. Each pocket 40 is bounded by an endwall 42, a front wall 44, a backwall 46 and a interior wall 48, each of which comprises an integral part of the housing 30. The front wall 44 and the backwall 46 extend parallel to the slot 34 along the portion of the length of the housing 30. Endwall 42 extends generally perpendicular to the slot 34. The interior wall 48 extends from the backwall 46 toward the front wall 44 but is separated from the front wall 44 by a recess 56 through which a module 2 positioned within slot 34 extends. The interior wall 48 therefore extends over only a portion of the pocket 40. Interior wall 48 is parallel to and spaced from the adjacent endwall 42. The recess 56, provides communication between the slot 34 and the pocket 40. In this manner the slot 34 communicates with the pocket 40 beyond the interior wall 48 while at the same time permitting the pocket 40 to be bounded on four sides by at least part of an integral housing wall. Each pocket 40 is upwardly open but is bounded by a lower surface from which the respective walls extend upwardly. The endwall 42 has a groove extending upwardly from the bottom. This groove 58 forms an opening which communicates to the interior of the pocket 40.

An upwardly extending projection 50 is located adjacent each pocket 40. This upwardly extending projection 50 extends upwardly from the backwall 46 so that it is formed on one of the walls defining the pocket 40. The upwardly extending projection 50 includes a securing pin 52 which extends transverse to the direction of the slot 34 and is located above both the slot 34 and the pocket 40. The configuration of the securing pin 52 is such that it can be received within one of the holes 12 on the circuit panel 4 of the electronic module 2. The upwardly extending projection 50 is set back from the exterior of the backwall 46 to define a shoulder behind the upwardly extending projection 50 and below the securing pin 52. The securing pin 52 extends from the front of the upwardly extending projection 50 whereas the shoulder 54 extends along the rear of projection 50. Each support 38 includes a pocket 40 and the respective walls defining these pockets comprise mirror images of each other, since one is located on the left and the other is located on the right of the insulative housing 30. The insulative housing 30 is positioned within a printed circuit board 14 by mounting pegs 56 extending from the bottom of the housing 30.

The plurality of terminals 22 positioned within the cavities 36, are configured to establish electrical contact with the connecting pads 21 on the module 2 upon rotation of the module to a first or upright position. Each of the terminals 22 will apply a moment to the module when the module is in the upright first position. In order to resist the moment applied to the module 2 by the terminals 22, a U-shaped latch 100, which comprises means for holding the module in the first position and resisting the moment applied by the module by the terminals, is positioned within each pocket 40. In the preferred embodiment of this invention a latch 100 is located on each end of the housing 30, but it should be understood that for a least some applications a single latch located on one end may be sufficient. In the preferred embodiment of this invention the U-shaped latch 100 comprises a separate member formed of a spring metal. It should be understood that in some applications a separately molded U-shaped latch could be employed Use of a plastic U-shaped latch might be suitable where the insulative housing is manufactured from a relatively inflexible plastic whereas the latch might be manufactured from a resilient, and therefore more expensive, plastic. In conjunction with the pocket 40, and the supports 38, the U-shaped latch 100 comprises the means for holding the module in the first position. In the preferred embodiment of this invention the U-shaped latch 100 is attached only to the endwall 42. In the undeflected state, however, the U-shaped latch engages both the endwall 42 and the interior wall 48.

The U-shaped latch 100 comprises an inner leg 102 joined to an outer leg 104 by a intermediate bight section 106 which is located at the bottom of the U-shaped latch. The inner leg 102 engages the interior wall 48 when the latch is in the undeflected configuration. The outer leg 104 is attached to the housing at a point adjacent to the upper end of the latch. Upon deflection of the U-shaped latch 100 by engagement of a wedge shaped projection 110 located at the top of the inner leg 102, with the module 2, during rotation of the module, the U-shaped latch is stressed throughout its length between the wedge shaped projection and the point of attachment between the outer leg 104 and the housing, therefore forming a compliant spring. The U-shaped latch 100 is inserted into its corresponding pocket 40 from the top of the housing and the latch is positioned so that the bight is positioned above the lower surface of the pocket 40 and such that the bight is unrestrained by the lower surface during deflection of the latch 100. In order to make the latch 100 more resilient, a central cutout 108 extends through the bight 106 and into each of the legs 102 and 104.

Figure 14:
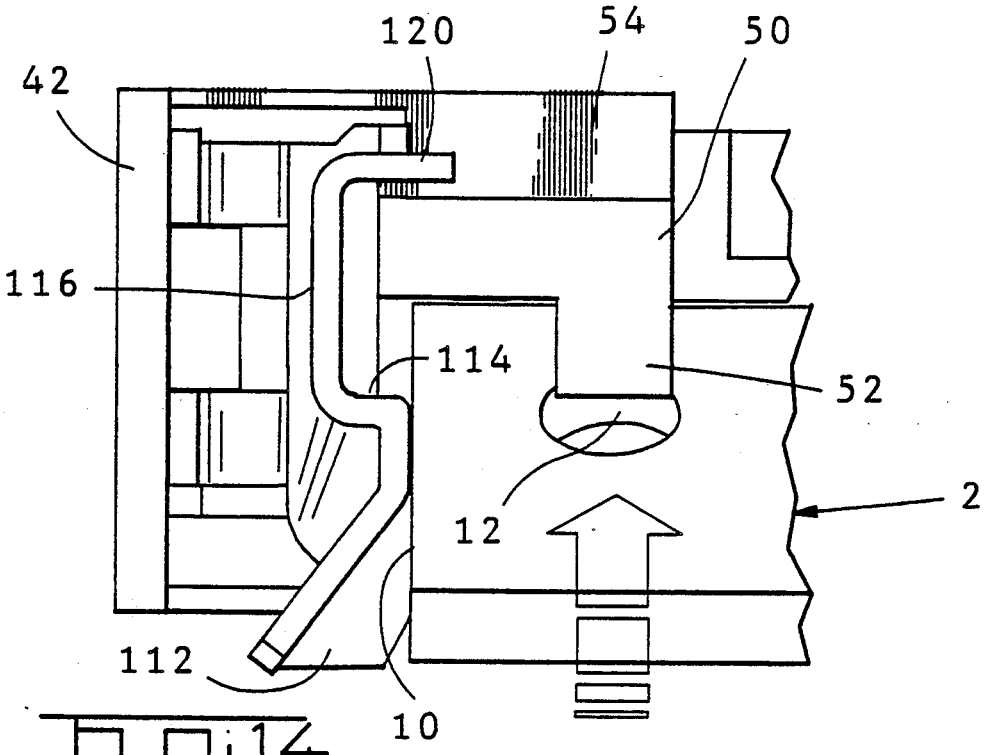
FIGS. 14 and 15 illustrate the manner in which a single in-line memory module socket is rotated into position in a socket and showing the manner in which the resilient metal latch deflects.
Figure 15:
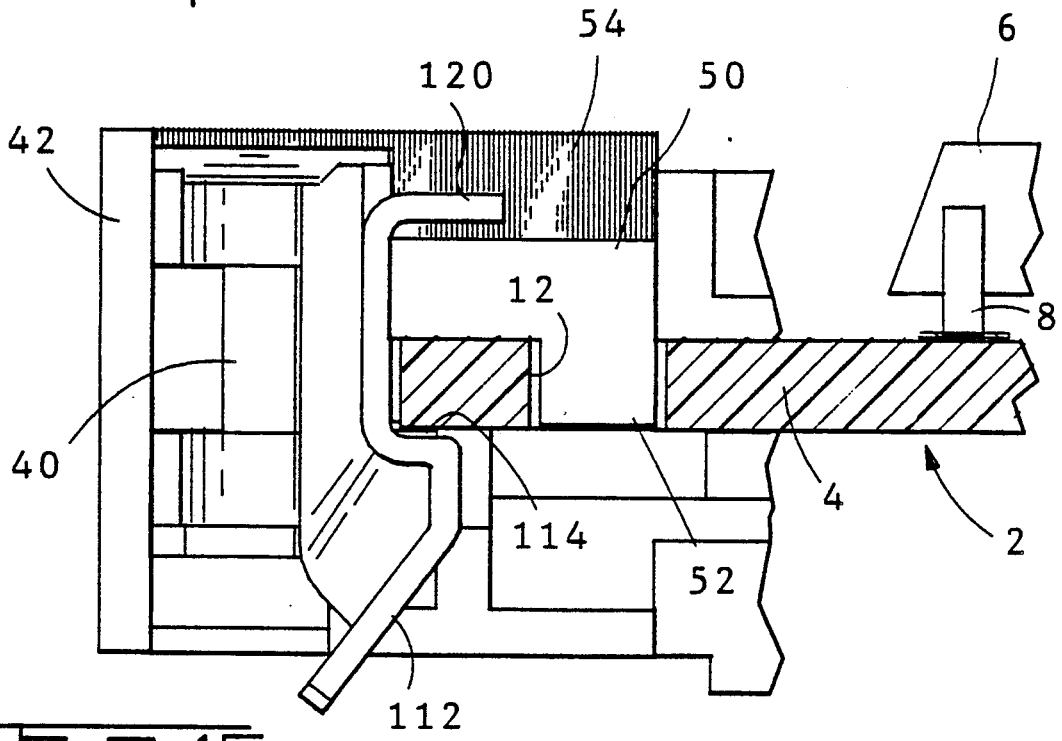
Figure 16:
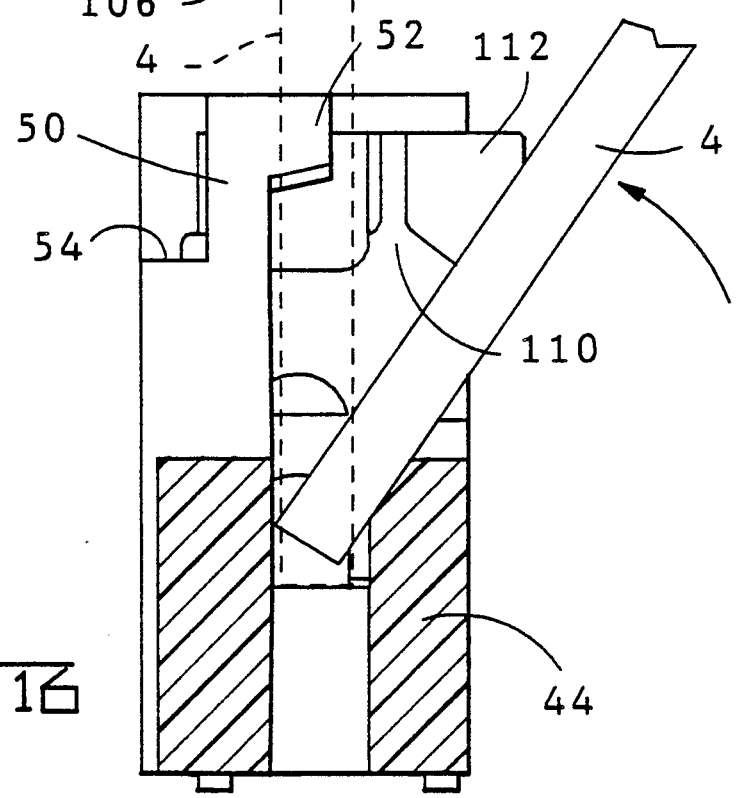
FIG. 16 is an end view, partially in section, illustrating the rotation of a module from the insertion position to the upright position.

Each latch 100 includes a wedge shaped projection 110 located at the upper end of the inner leg 102. It is this wedge shaped projection 110 which engages an edge 10 on the circuit panel 4 of an electronic module 2. The U-shaped latch 100 is deflected by the module as the module is rotated into the first position and during this rotation, the edge of the module 2 engages the wedge shaped projection 110. During rotation of the electronic module 2, each of the latches 100 is deflected outwardly at the end of the slot 34. Once the electronic module reaches the upright first position, the U-shaped latch 100 holds the electronic module in the housing in engagement with the terminals. Rotation of the module 2 into the upright position is illustrated in FIGS. 14–16.

The wedge shaped projection 110 comprises a deep drawn section of the stamped and formed latch 100 and is located adjacent the forward end of the U-shaped latch 100. Wedge shaped projection 110 protrudes from the top of the pocket 40 and includes a forward surface 112 which is inclined toward the outer leg 104. A smooth surface which will not damage the edge of the circuit panel is thus formed at the front of the wedge shaped projection 110. A rear stop surface 114 located immediately rearward of the forward inclined surface 112, extends perpendicular to the outer leg 104. This rear stop surface 114 is, however, located on the inside surface of the wedge shaped section 110. Rear stop surface 114 is joined to a flat section 116 which is located immediately rearward of the stop surface 114. Rear stop surface 114 extends perpendicular to the flat section 116 which in turn extends rearwardly from the stop surface 114. Flat section 116 is parallel with the outer leg 104. The length of this flat section 116 is sufficient such that when the module 2 is in its first upright position, the edge 110 of the module is positioned adjacent the flat section 116.

A tab 120 is located at the rear of the wedge section 110 on the top of the U-shaped latch 100. The tab 120 is located at the rear end of the flat section 116. Tab 120 extends inwardly from flat section 116 and is generally perpendicular to the flat section 116. Tab 120 is parallel to the stop surface 114 and is spaced from the stop surface by a distance sufficient for receipt of not only the module 2 but also a portion of the upwardly extending projection 50 between the stop surface 114 and the tab 120. With the U-shaped latch 100 positioned within pocket 40, the tab 120 is wrapped around at least a portion of the upwardly extending projection 50 so that the upwardly extending projection 50 provides support for the U-shaped latch. The backwall 46 and the upwardly extending projection 50 are generally sturdier than the other walls defining the pocket 40. In particular, the upwardly extending projection 50 located on backwall 46 is sturdier than the relatively thin endwall 42. By wrapping the tab 120 around this upwardly extending projection 50, additional support is provided to the U-shaped latch 100 as this latch resists the moment applied to the modules 2 by the terminals 22. The tab 120 is positioned behind the projection 50 and on top of the shoulder 54. During deflection of the U-shaped latch 100 the tab 120 is free to move along the rear of the upward extending projection 50 and along the shoulder 54.

The U-shaped latch 100 is insertable into the pocket 40 from above. A barb 118 formed outwardly on the outer leg 104 is received within the groove 58 on the endwall 42 when the U-shaped latch 100 is fully inserted into the pocket 40. Interengagement between the barb 118 and the groove 58 thus prevents the U-shaped latch from being inadvertently dislodged from the pocket 40 and also provides a fixed point adjacent to upper end of the latch on the outer leg 104. In this position the entire U-shaped latch 100 is free to deflect between the point of engagement of barb 118 and groove 58 and the relatively inflexible deep drawn wedge section 110. Note that the U-shaped latch 100 deflects by movement of the inner leg 102 towards the outer leg 104. While the endwall 42 is sufficient to withstand the forces applied to the U-shaped latch 100 during deflection, the moment applied to the latch by engagement of terminals 22 to the module 2 can provide a greater force which, due to the relatively thin configuration of endwall 42 cannot be resisted by the endwall alone. The U-shaped latch can be flexed until the overstress member 122 extending inwardly from the top of the outer leg 104 engages the inner leg 102, the endwall is not required to provide the only support for the latch 100 when the module is in the first position, fully engaged with the terminals. Note that the maximum moment applied to the module 2 by the terminals 22 occurs only after the module is rotated to its upright position and the latch has fully engaged the edge of the board along the rear stop surface 114 on the wedge section 110.

Figure 17:
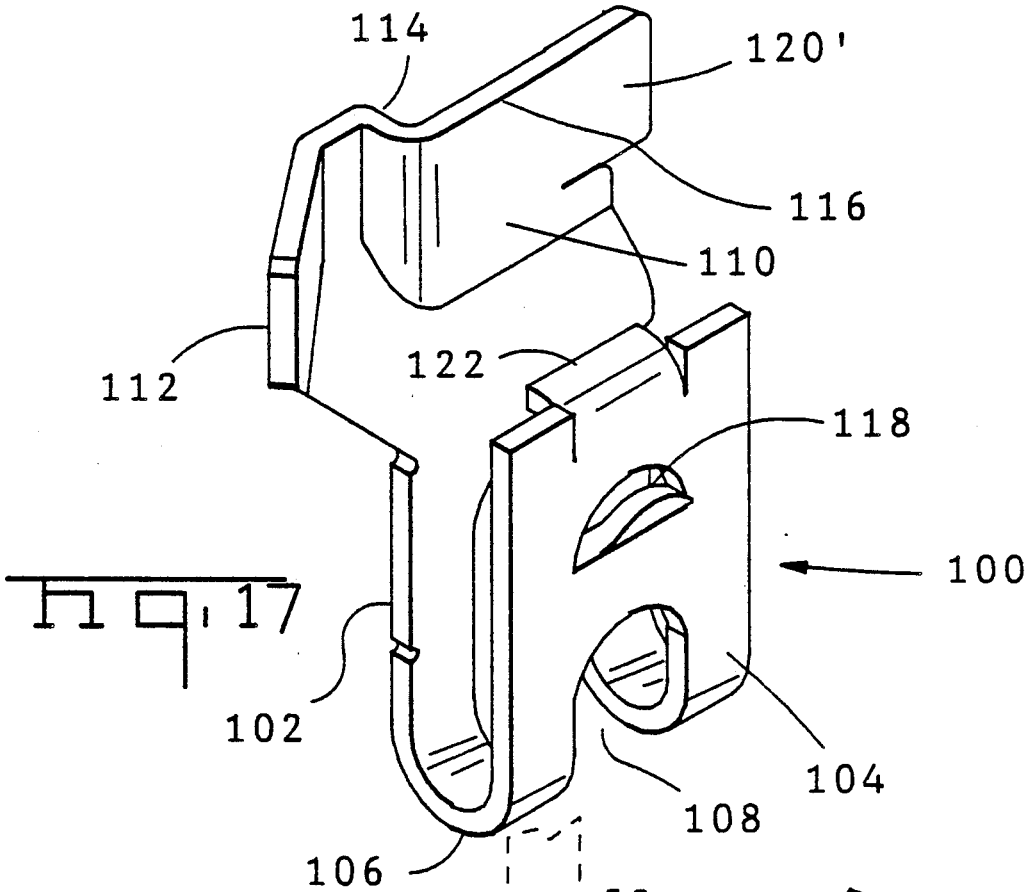
FIG. 17 is a view of an alternate embodiment of the latch.
Figure 18:
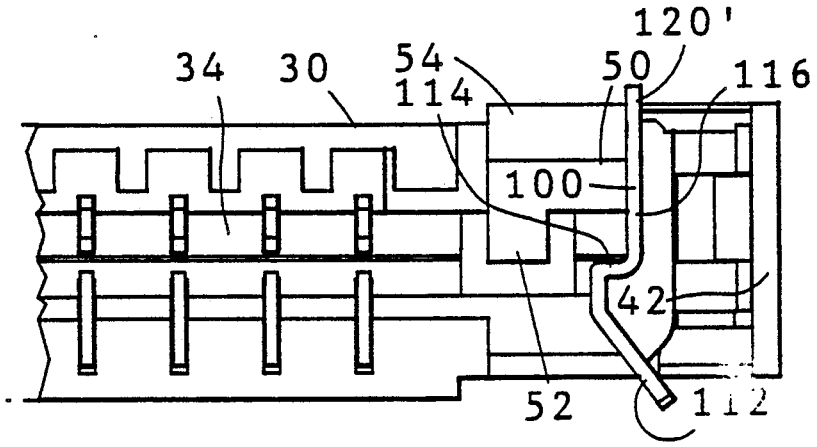
FIG. 18 is a top view of the socket using the alternate embodiment of the metal latch.

An alternate embodiment of a compliant metal latch is depicted in FIGS. 17 and 18. In this embodiment, the tab 120' on the metal latch extends straight back and is not bent to engage the projection 50. Tab 120' extends rearwardly beyond the insulative housing 30. Thus the tab 120' and the forward surface 112 each extend beyond the housing so that they are accessible to an operator who can deflect the latches for module insertion or removal. Accessibility of tab 120' is especially significant for a socket or sockets with two closely spaced modules. The latch holding the front module can be activated by engagement with forward surface 112. The latch holding the rear module can be deflected by pushing on tab 120'.

Changes in construction will occur to those skilled in the art various modification embodiments may be made without departing from the scope of the invention. The matter set forth in the foregoing description and the accompanying drawings is offered by way of illustration only. It is therefore intended that the foregoing description be regarded as illustrative rather than limiting.

What is claimed is:

1. A socket for interconnecting an electronic module to a circuit board, the socket comprising:

an insulative housing;

a plurality of terminals positioned within the insulative housing, the terminals being configured to establish electrical contact with the module upon rotation of the module to a first position, the terminals applying a moment to the module when the module is in the first position; and means, located on at least one end of the housing, for holding the module in the first position and resisting the moment applied to the module by the terminals;

the means for holding the module being characterized in that said means comprises a U-shaped latch positioned within a pocket in the insulative housing, the U-shaped latch having inner and outer legs joined by a bight at the bottom of the U-shaped latch, the inner leg having a wedge shaped projection at its upper end, the outer leg being attached to the housing at a point adjacent the upper end of the U-shaped latch so that upon deflection of the U-shaped latch by engagement of the wedge shaped projection with the module during rotation of the module, the U-shaped latch is stressed between the wedge shaped projection and the point of attachment between the outer leg and the housing thereby forming a compliant spring.

2. The socket of claim 1 wherein the U-shaped latch has a central cutout extending through the bight and into each leg so that the latch is more compliant.

3. The socket of claim 1 wherein the outer leg has a barb received within a groove on an end wall of the housing.

4. The socket of claim 1 wherein the U-shaped latch comprises a member fabricated from a spring metal.

5. The socket of claim 1 wherein the bight of the U-shaped latch is positioned above a lower surface of the housing defining the pocket, the bight being unrestrained by the lower surface during deflection of the latch.

6. The socket of claim 5 wherein the pocket is formed by an end wall, a front wall, a back wall and an interior wall, the interior wall extending from the back wall toward the front wall and being separated from the front wall by a recess through which the module extends, the U-shaped latch being attached only to the end wall but engaging both the end wall and the interior wall when in an undeflected state.

7. The socket of claim 1 wherein the wedge-shaped projection comprises a forward surface inclined toward the outer leg and a rear stop surface extending perpendicular to the outer leg.

8. The socket of claim 7 wherein the wedge shaped projection is located adjacent a forward end of the U-shaped latch, the rear stop surface being joined to a flat section extending rearwardly from the stop surface and parallel to the outer leg.

9. The socket of claim 8 wherein the wedge-shaped projection comprises a deep-drawn section of the latch.

10. The socket of claim 1 wherein one wall defining the pocket includes an upwardly extending projection and the U-shaped latch includes a tab which is wrapped around the upwardly extending projection so that the upwardly extending projection provides support for the U-shaped latch.

11. The socket of claim 10 wherein the projection includes a securing pin extending transverse to the slot, the securing pin being received in a hole adjacent the edge of the module engaged by the latch.

12. A socket for interconnecting an electronic module to a circuit board, the socket comprising:

an insulative housing:

a plurality of terminals in the housing, positioned to engage the module;

at least one latch for holding the electronic module in the housing in engagement with the terminals;

the socket being characterized in that each latch is received within a pocket in the housing, the pocket being formed by a back wall, a front wall, an end wall and an interior wall, a projection extending upwardly above the pocket from an inner part of the back wall, a shoulder being formed behind the projection on the back wall, the latch having a tab positioned behind the projection and on the shoulder, so that the latch is supported by the back wall.

13. The socket of claim 12 the latch is inserted into the pocket through the top of the socket.

14. The socket of claim 12 wherein the latch has a wedge section protruding from the pocket.

15. The socket of claim 12 the end wall has a groove extending upwardly from the bottom of the end wall and the latch has a barb positioned within the recess to hold the latch in the pocket.

16. The socket of claim 12 each of the walls comprises a part of the housing, the housing comprising a molded one-piece member, the latch comprising a separate member positioned within the pocket.

17. The socket of claim 12 wherein the latch comprises a U-shaped member having an outer leg engaging the end wall and and an inner leg engaging the interior wall when the latch is undeflected.

18. The socket of claim 17 wherein the outer leg of the latch is secured to the end wall of the housing.

19. The socket of claim 12 wherein the housing has a slot into which the module can be inserted, the terminals protruding into the slot to engage a module positioned in the slot, the slot communicating with the pocket.

20. The socket of claim 19 wherein the interior wall extends over only a portion of the pocket, the slot communicating with the pocket beyond the interior wall.

* * * * *